United States Patent [19]

Wolters

[11] 4,026,509

[45] May 31, 1977

[54] ADJUSTABLE STANDARD FOR SWIVEL CHAIR

[75] Inventor: Richard H. Wolters, Grand Rapids, Mich.

[73] Assignee: Herman Miller, Inc., Zeeland, Mich.

[22] Filed: Aug. 16, 1976

[21] Appl. No.: 714,799

Related U.S. Application Data

[63] Continuation of Ser. No. 648,795, Jan. 13, 1976, abandoned.

[52] U.S. Cl. ..... 248/406; 108/147

[51] Int. Cl.[2] ..... F16M 11/00; F16M 13/00

[58] Field of Search ..... 248/404, 405, 406, 415, 248/157, 188.4, 125; 108/147, 136, 144; 297/339, 347

[56] References Cited

UNITED STATES PATENTS

| | | | |
|---|---|---|---|
| 2,702,075 | 2/1955 | Richards | 108/136 |
| 3,164,357 | 1/1965 | Hage et al. | 248/406 |
| 3,386,697 | 6/1968 | Helms | 248/406 |
| 3,391,893 | 7/1968 | Doerner | 248/405 |
| 3,599,924 | 8/1971 | Schmidgall | 248/353 |
| 3,727,871 | 4/1973 | Harper | 248/406 |
| 3,778,014 | 12/1973 | Driscoll et al. | 248/406 |
| 3,799,485 | 3/1974 | Wolters | 248/406 |
| 3,799,486 | 3/1974 | Mohr et al. | 248/406 |
| 3,870,270 | 3/1975 | Holtz | 248/406 |
| 3,870,271 | 3/1975 | Bowman | 248/406 |

FOREIGN PATENTS OR APPLICATIONS

| | | | |
|---|---|---|---|
| 687,506 | 1/1940 | Germany | 248/406 |
| 1,029,020 | 4/1966 | United Kingdom | 248/406 |

*Primary Examiner*—J. Franklin Foss

*Attorney, Agent, or Firm*—Price, Heneveld, Huizenga & Cooper

[57] ABSTRACT

A supporting spindle for a chair is disclosed which can be shifted from a mode in which the height of the seat is adjusted by rotating the seat while the seat is occupied to a mode in which the seat can be rotated in either direction without effecting any change in vertical position when the seat is occupied. The change in mode is effected by the release of a lock when the spindle is downwardly telescoped against the bias of a spring by the weight of the seat's occupant.

8 Claims, 7 Drawing Figures

ADJUSTABLE STANDARD FOR SWIVEL CHAIR

CROSS REFERENCE TO RELATED APPLICATION

This is a continuation of application Ser. No. 648,795 filed Jan. 13, 1976 now abondoned.

BACKGROUND OF THE INVENTION

It is conventional practice in the construction of chairs, particularly for commercial and office use to provide means whereby the chair may be rotated, that is swiveled, and also the height of the seat can be vertically adjusted. In some cases, rotation is accomplished by means of casters on the base and, in other cases, the chair is made rotatable by the construction of its supporting spindle or standard. Vertical adjustment of the seat height is normally accomplished by providing a threaded member which, upon rotation of the seat, raises or lowers the height of the seat.

The problem of providing both in a simple structure non-height adjusting rotation and height adjustment has not heretofore been satisfactorily solved. The problem arises from the fact that if the seat is made freely rotatable on the spindle, it has then not been possible to make the vertical adjustment by means of a threaded member without the use of complicated locking and release mechanisms. These mechanisms have required the operator to manipulate various handles or loosen various screws or nuts so that rotation of the seat will either effect vertical adjustment or it will be functionally disconnected from the threaded member so that the threaded member remains stationary even though the seat is rotated. This arrangement has proved particularly unsatisfactory not only from a functional but also from an aesthetic point of view.

SUMMARY OF THE INVENTION

This invention provides a chair support the seat of which, when occupied, may be rotated freely without effecting any vertical adjustment of the height of the seat. Alternately, when the seat is not occupied, rotation of the seat will effect vertical adjustment. This invention provides a mechanism which, when the chair is unoccupied automatically effects a lock between one of two members and a clutch which permits relative rotation between two engaged, threaded members whereby rotation of the seat will effect a threaded adjustment of the height of the seat, the direction of the adjustment being determined by the direction of rotation of the seat. However, when the chair seat is occupied, the lock is rendered inoperative and the clutch type mechanism is also rendered inoperative whereby both the threaded member and the nut through which it operates will rotate together. In this manner, the chair's occupant may freely rotate the seat without adjusting its vertical position. The mechanism eliminates the necessity for the operator making any adjustments, turning any knobs or otherwise manipulating any part of the mechanism.

DESCRIPTION OF THE PREFERRED EMBODIMENT

Figure 7:
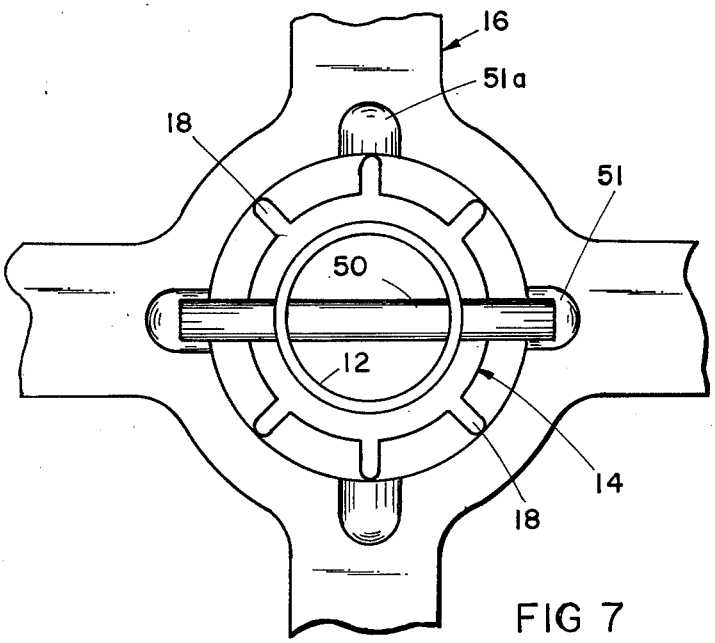
FIG. 7 is a fragmentary view of the bottom of the base showing the interengagement of the spindle and the base.
Figure 2:
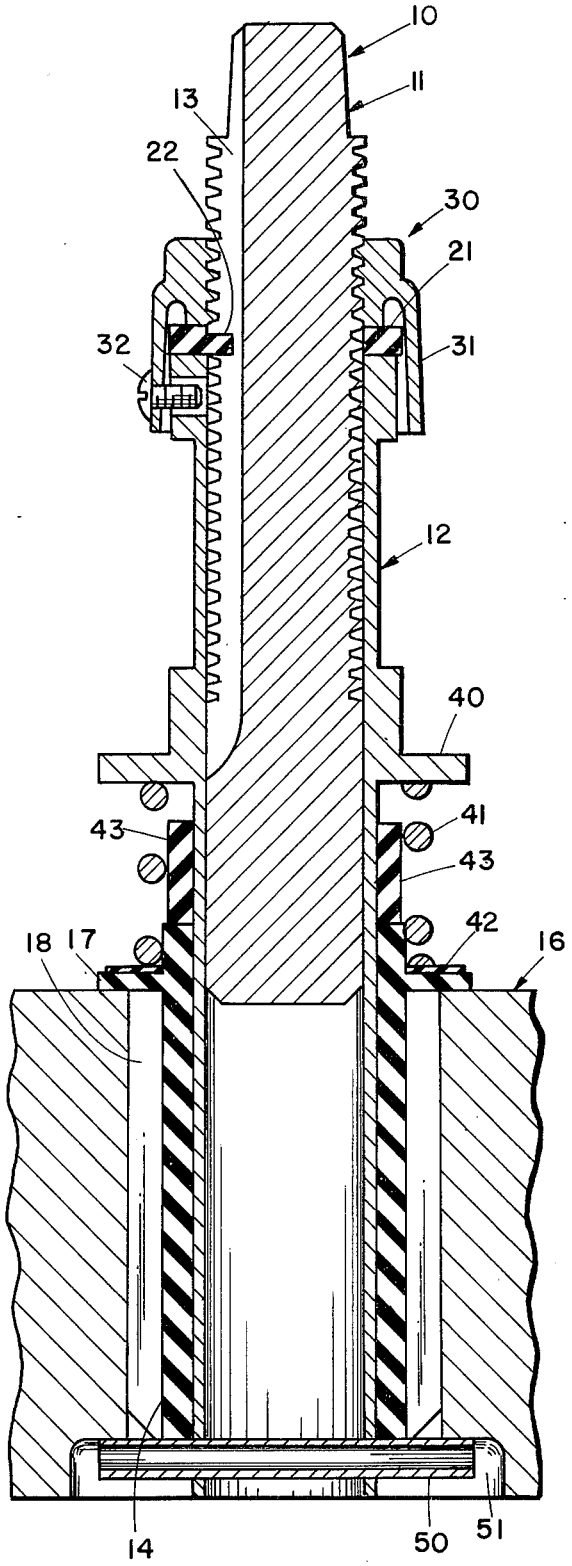
FIG. 2 is an enlarged, central sectional view of a chair spindle structure incorporating this invention, showing the spindle in the position it assumes when the chair is not occupied.
Figure 3:
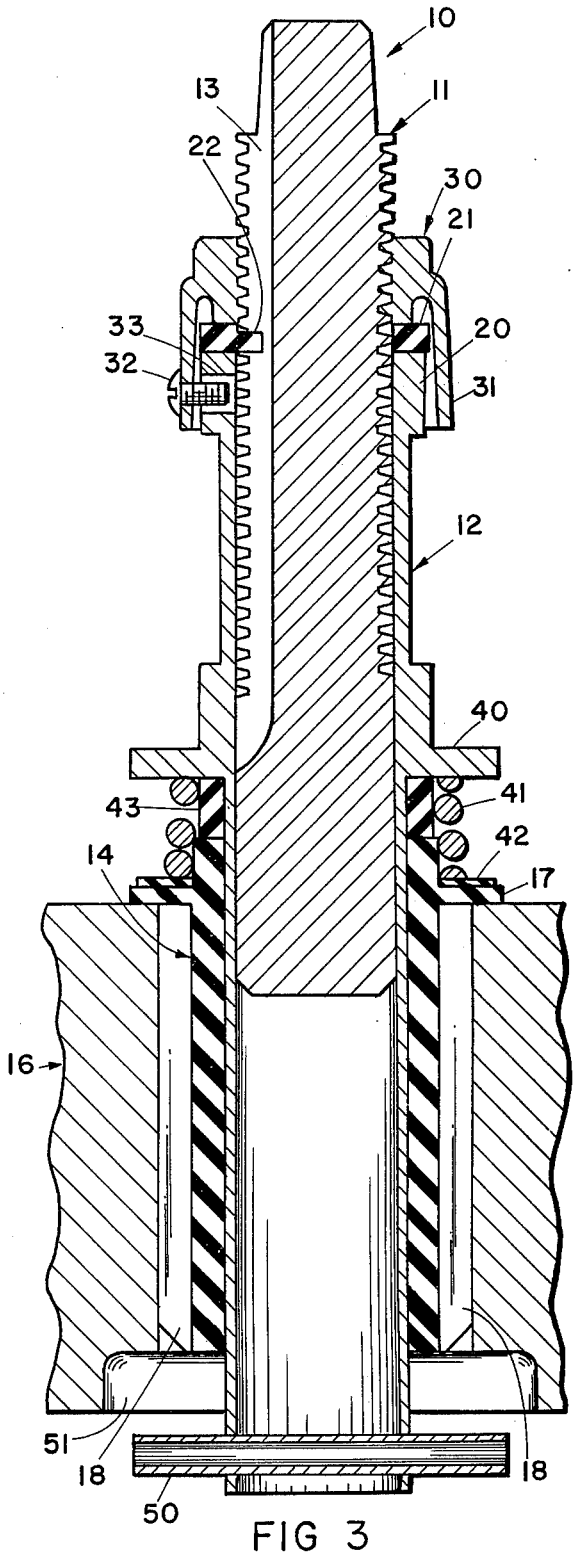
FIG. 3 is a view similar to FIG. 2 showing the position the spindle assumes when the chair seat is occupied.

Referring to FIGS. 2 and 3, the numeral 10 designates a spindle having as its two primary components a threaded shaft 11 and a tubular post 12. The shaft 11 is telescopically received within the post 12. The interfit is such that one component can freely rotate or shift vertically with respect to the other. However, the fit is close enough that the post supports the shaft without noticeable lateral or rocking displacement. The shaft 11 is threaded for a substantial portion of its length. It is also provided with a keyway 13. The upper end of the shaft 11 is designed to be attached to a chair seat by any suitable means. The lower end of the post 12 is not threaded and is rotatably and slidably mounted in an elongated bushing 14. The bushing, in turn, is seated in a suitable opening 15 in a supporting base 16. Preferably, it is press fitted into this opening. The bushing has a radially extending flange 17 at its upper end which rests on the top of the boss 16. To facilitate installation and to accommodate reasonable tolerances, the bushing's exterior surface is provided with a plurality of ribs 18 (FIG. 7). The bushing is preferably molded from a plastic material. The specific structure of the bushing is not a part of this invention. Therefore, further description of it is not considered necessary. In the arrangement illustrated, the bushing 14 extends substantially all the way through the base 16 and the post 12 extends downwardly beyond the bushing.

Figure 6:
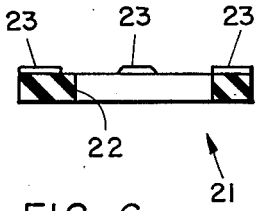
FIG. 6 is a sectional elevation view taken along the plane VI-VI of FIG. 5.
Figure 5:
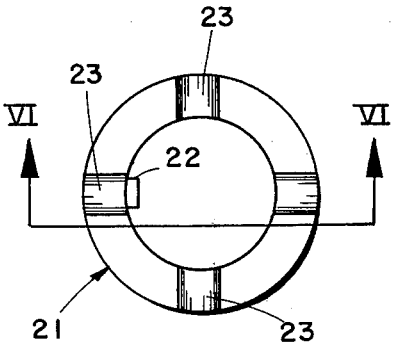
FIG. 5 is a plan view of the clutch ring of the invention.

A radial collar 20 surrounds the top of the post. Seated on top of the collar 20 is a clutch plate or ring 21. The clutch ring 21 as best seen in FIGS. 3, 5 and 6 and an annulus having a radially inwardly extending finger 22 of a size to seat in the keyway 13 of the shaft 11. The upper surface of the clutch ring has four equally spaced raised protrusions or projections 23. The protrusions 23 have sloping sides (FIG. 6). The clutch ring 21 preferably is manufactured of a lubricious material having good resistance to wear and also to distortion under compression loading. An example of suitable material is Nylon 6 sold by E. I. Dupont de Nemoirs Co.

Seated on the clutch ring 21 is a cap 30. The cap has apron-like depending sides 31 which seat down over the collar 20. Suitable means such as the fastener 32 connect the cap 30 to the post 12 so that rotation of one will automatically result in rotation of the other. The hole 33 in the collar for the fastener 32 is enlarged, at least vertically, to permit a limited amount of vertical play or relative travel of the cap 30 with respect to the post 12.

Figure 4:
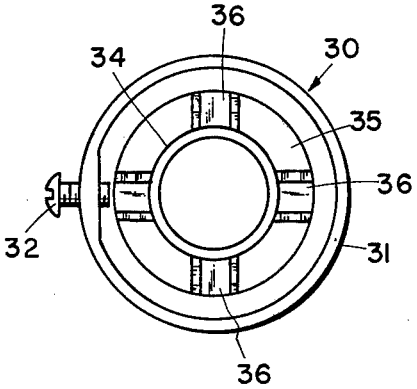
FIG. 4 is a bottom view of the cap for the post of the spindle.

The top of the cap 30 has a concentric threaded opening 34 which threadedly engages the shaft 11. The inside of the cap provides an annular surface 35 surrounding the opening 34 (FIG. 4).The surface 35 has four equally spaced pockets 36, each of a size and shape to receive one of the protrusions 23 on the clutch ring 21. The pockets 36, like the protrusions 23, have sloping sides to facilitate displacement of the protrusions from the pockets under certain operating conditions. The relative vertical displacement permitted by the oversize or vertically elongated opening 33 is sufficient to permit the protrusions 23 to be displaced from the pockets 36 and the clutch ring 21 to rotate with respect to the cap 30 with the surface 35 resting on the top of the protrusions.

Below the collar 20, the post 12 has an outwardly extending flange 40. Like the collar 20, the flange 40 is either integral with the post or is rigidly secured to it. A compression spring 41 surrounds the post 12 and has one end supported on the bushing 14 and the other end seated aganist the undersurface of the flange 40. A washer 42 provides a suitable wear resistant surface for the lower end of the spring. A sleeve 43 of suitable material such as rubber surrounds the post 12 inside the spring. The sleeve's primary function is as a sound deadener. It can, under proper circumstances, also serve as a cushion or shock absorber should the weight imposed on the chair cause the spring 41 to bottom out. Such a function is suggested in FIG. 3.

Upward movement of the post 12 under the influence of the spring 41 is limited by the stop pin 50 which extends diametrically through the bottom of the post. The pin 50 is received in either of two suitable slots 51 or 51*a* arranged normal to each other in the lower surface of the base 16 (FIGS. 2, 3 and 7). When the chair is unloaded, the spring 41 shifts the post 12 to seat the pin 50 in one of the slots 51 or 51*a* thus locking the post against rotation (FIG. 2). This is the condition prevailing when the seat of the chair is unoccupied.

Figure 1:
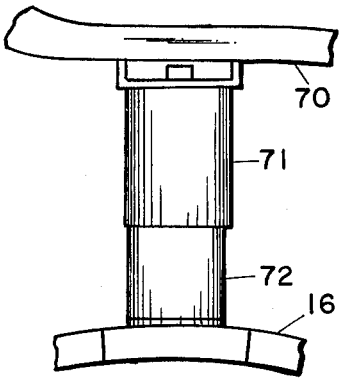
FIG. 1 is a fragmentary side elevation view of a chair incorporating this invention.

When the spindle 10 is in the position illustrated in FIG. 2, should the chair seat 70 (FIG. 1) be rotated, it will turn the shaft 11. By reason of the interengagement of the finger 22 of the clutch ring 21 and the keyway 13, the clutch ring 21 will be forced to rotate with the shaft. However, since the post 12 is positively locked against rotation by the pin 50 being seated in one of the slots 51 or 51*a*, the protrusions 23 on the clutch ring 21 will be forced out of the pockets 36 in the cap 30 causing the cap, shaft and seat to lift slightly. This slight lifting requires only the lifting of the weight of the cap, shaft and the seat because of the lost motion connection between the cap and the post. Since this results in rotation of the shaft 11 with respect to the cap 30, the vertical position of the shaft shifts with respect to the cap and post. In this manner, the height of the chair seat can be adjusted when it is unoccupied simply by rotating the seat. No other act or maneuver by the operator is required. It will be seen that during this phase of operation, the protrusions 23 and the pockets 36 function as a detent permitting rotational displacement between the cap and clutch ring and thus relative rotation between the shaft and post.

A different condition prevails when the chair seat is occupied. The spring 41 is designed to compress to the position illustrated in FIG. 3 when sufficient downward force is imposed upon it. Functionally, this force should be sufficiently less than the normal weight of a chair occupant to assure positive downward shifting of the post 12. A force of 75 to 90 pounds is considered functional for this purpose.

When the post 12 is shifted to its lowered position, the lock pin 50 is released since it is displaced from the slots 51 or 51*a*. Release of the pin 50 permits the post to rotate in the bushing 14. The weight of the occupant acting upon the cap 30 and pressing the cap downwardly tightly against the clutch ring 21 prevents release of the clutch in view of the fact that the post is now free to rotate. The force necessary to rotate the post is but a fraction of that necessary to cause release of the clutch ring-cap interengagement. Thus, the chair occupant can freely pivot the chair seat without changing the vertical adjustment of the seat.

It will be understood that the invention makes possible a chair support which is both fully rotatable and at the same time capable of vertical adjustment without the operator having to manipulate any levers, screws, handles or the like. Further, the entire adjustment function can be performed without lifting or tipping the chair. To make a vertical adjustment all the user has to do is to get up and spin the seat. Because the necessity for levers, screws, handles and the like has been eliminated, it is possible to enclose the entire mechanism in a near, aesthetically pleasing sleeve-type housing such as the telescoping sleeves 71 and 72 shown in FIG. 1.

The invention provides a simple, compact and dependable, rotatable and adjustable chair support. It also provides a support which, by reason of its chair design contributes materially to the aesthetic appearance of the chair.

While a preferred embodiment of the invention has been illustrated and described, it will be recognized that various modifications of the invention can be made without departing from its principles. Such modifications are to be considered as included in the hereinafter appended claim unless their language expressly state otherwise.

The embodiments of the invention in which an exclusive property or privilege is claimed are defined as follows.

1. An adjustable support spindle for a chair seat capable of both rotation and vertical adjustment, a base supporting said spindle, said spindle having a threaded shaft and a tubular post telescopically receiving said shaft, said post rotationally and slidably mounted through said base, cap means secured to the upper end of said post and threadedly engaging said shaft; clutch means having one element securing said clutch means to said shaft for rotation therewith and a releasable detent member engaging said cap means; a lock member at the lower end of said post and a downwardly opening pocket in said base for receiving said lock member and holding said post against rotation when said lock means is seated therein; a spring normally urging said post upwardly and said lock means into said pocket whereby said spindle can turn with respect to said cap upon release of said detent means effecting vertical adjustment of said spindle; said spring having a predetermined compression value less than the weight of an occupant of the chair seat whereby when the chair seat is occupied said post shifts downwardly and said lock member disengages said pocket to free said post and cap to rotate with said spindle.

2. An adjustable support spindle for a chair seat capable of both rotation and vertical adjustment, a base supporting said spindle, said spindle having a threaded shaft and a tubular post telescopically receiving said shaft, said post rotationally mounted to said base and vertically slidable with respect thereto between a raised position and a lowered position, a cap secured to the upper end of said post and threadedly engaging said shaft; clutch means engaging said shaft for rotation therewith and having a releasable detent member engaging said cap; a lock member at the lower end of said post engaging said base to hold said post aganist rotation with respect to said base when said post is in raised position and disengaging said base when said post is in lowered position; a spring normally urging said post to raised position, locking said post and cap against rotation whereby rotation of said spindle will release said detent means effecting vertical adjustment of said spindle; said spring having a predetermined compression value less than the weight of an occupant of the chair seat whereby when the chair seat is occupied said post and cap shifts to its lowered position and is released to rotate with said spindle.

3. An adjustable support spindle for a chair seat capable of both rotation and vertical adjustment, a base supporting said spindle, said spindle having a threaded shaft for attachment to a seat and a tubular post mounted to said base; threaded means on said post threadedly engaging said shaft and clutch means secured to said shaft for rotation therewith and having releasable rotational engagement with said threaded means; said post being vertically slidable with respect to said base between a raised position and a lowered position; a spring urging said post into raised position; a locking element on said post engaging said base and holding said post aganist rotation whereby rotation of said shaft will cause said clutch to release permitting said shaft to shift axially of said post as it rotates; said locking element disengaging said base to free said post for rotation with said shaft when said post is in lowered position.

4. An adjustable support spindle for a chair seat as described in claim 3 wherein a bushing surrounds the portion of said post seated within said base; said bushing having a radially extending flange at its upper end seated on the top of said base; a radially extending collar on said post; said spring being seated between said flange and said collar.

5. An adjustable support spindle for a chair as described in claim 4 wherein a resilient sleeve surrounds said post between said post and said spring.

6. An adjustable support spindle for a chair as described in claim 3 wherein said threaded means is a cap; a fastener securing said cap to said post for rotation therewith and limited vertical travel with respect thereto; said clutch means being an annular plate and said plate and said cap having interfitting protrusions and pockets providing the releasable rotational engagement therebetween; said protrusions and pockets releasing each other when said cap shifts upwardly with respect to said plate.

7. An adjustable support spindle for a chair seat capable of both rotation and vertical adjustment, a base supporting said spindle, said spindle having a threaded shaft and a tubular post; threaded means on said post threadedly engaging said shaft and clutch means secured to said shaft for rotation therewith and and having releasable rotational engagement with said threaded means; said spindle being vertically slidable with respect to said base between a raised position and a lowered position; a spring urging said spindle into raised position; a locking element on said spindle engaging said base and holding one of said post and shaft against rotation when said spindle is in raised position whereby rotation of the other of said shaft and spindle will cause said clutch to release permitting said shaft to shift axially of said post as it rotates; said locking element disengaging said base to free the one of said post and spindle for rotation with the other thereof when said spindle is in lowered position.

8. A spindle support for a chair seat and a base mounting said spindle, said spindle having a threaded member and a nut engaging said threaded element; an element having a releasable lock for holding said nut against rotation and a spring urging said lock into locking position; and a releasable clutch interconnecting said threaded member and said nut and releasable when the chair seat is unoccupied to permit relative rotation between said threaded member and nut to effect vertical adjustment of the chair seat; said spring being compressible under the weight of a chair seat occupant for shifting said releasable lock to release position and said clutch being rendered inoperative when the chair seat is occupied to permit simultaneous rotation of the chair seat, nut and threaded member without change in the vertical position of the chair seat.

* * * * *